US005996599A

United States Patent [19]

Hulskotte

[11] Patent Number: 5,996,599

[45] Date of Patent: Dec. 7, 1999

[54] CLEANING DEVICE FOR PUNCTURE-RESISTANT PROTECTIVE GLOVES AND THE LIKE

[76] Inventor: Jan Henkrik Hulskotte, Kloppendijk 52, NL-7591 BT Denekamp, Netherlands

[21] Appl. No.: 08/945,980

[22] PCT Filed: Jul. 26, 1995

[86] PCT No.: PCT/EP95/02963

§ 371 Date: Feb. 20, 1997

§ 102(e) Date: Feb. 20, 1997

[87] PCT Pub. No.: WO96/03227

PCT Pub. Date: Feb. 8, 1996

[30] Foreign Application Priority Data

Jul. 28, 1994 [DE] Germany ..... 44 26 636
Nov. 10, 1994 [DE] Germany ..... 44 40 084

[51] Int. Cl.[6] ..... B08B 3/02

[52] U.S. Cl. ..... 134/137; 134/131; 134/157; 134/144

[58] Field of Search ..... 134/198, 137, 134/131, 124, 140, 157, 158, 129, 144, 155

[56] References Cited

U.S. PATENT DOCUMENTS

| | | | |
|---|---|---|---|
| 2,263,627 | 11/1941 | Herold | 134/144 |
| 3,131,840 | 5/1964 | Berger et al. | 68/205 R |
| 5,409,545 | 4/1995 | Levey et al. | 134/22.18 |
| 5,482,066 | 1/1996 | Krueger | 134/111 |
| 5,507,060 | 4/1996 | Quimpo | 15/63 |

*Primary Examiner*—Randy Gulakowski
*Assistant Examiner*—Paul J. Lee
*Attorney, Agent, or Firm*—Jordan and Hamburg LLP

[57] ABSTRACT

The invention relates to cleaning equipment for puncture-resistant gloves and the like and to a support, which accommodates one or several holding mechanisms for puncture-resistant gloves, the support being constructed movably, so that each holding mechanism can be brought into the sphere of activity of a washing nozzle, which is connected with a supply of cleaning liquid.

19 Claims, 2 Drawing Sheets

Fig.1
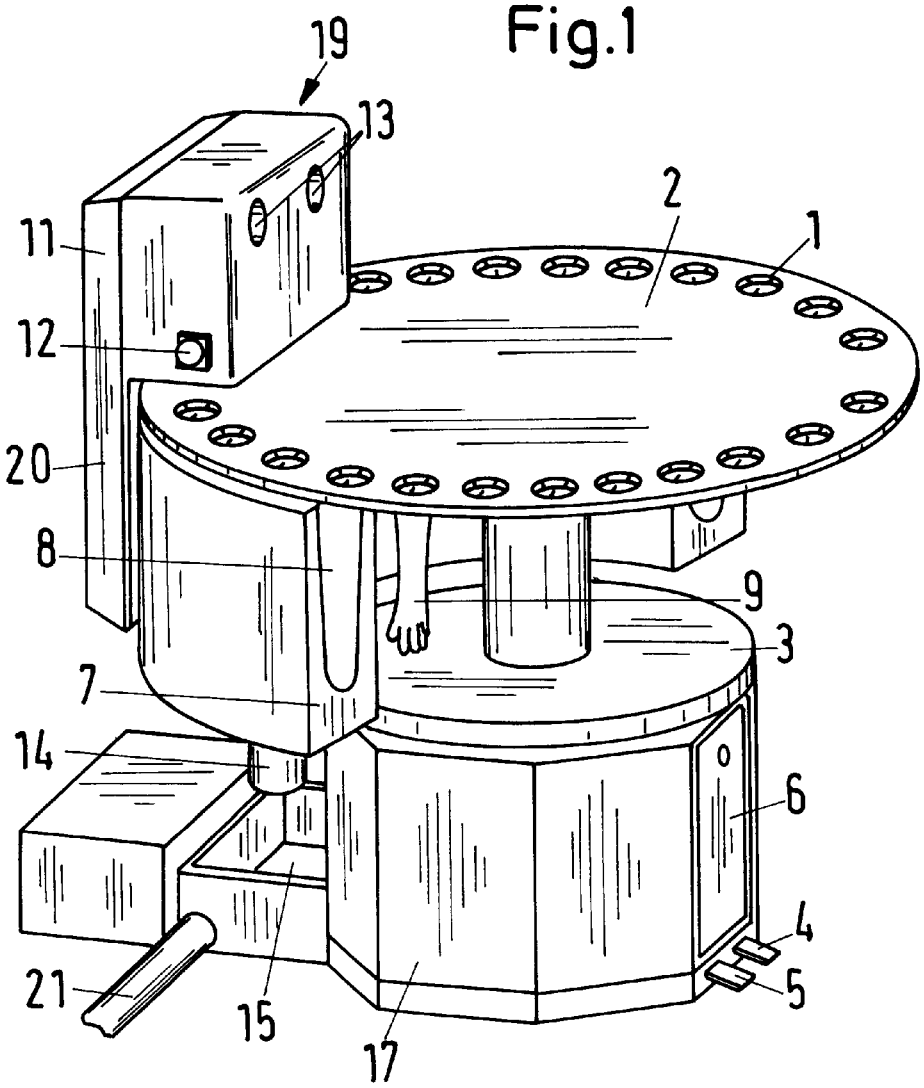
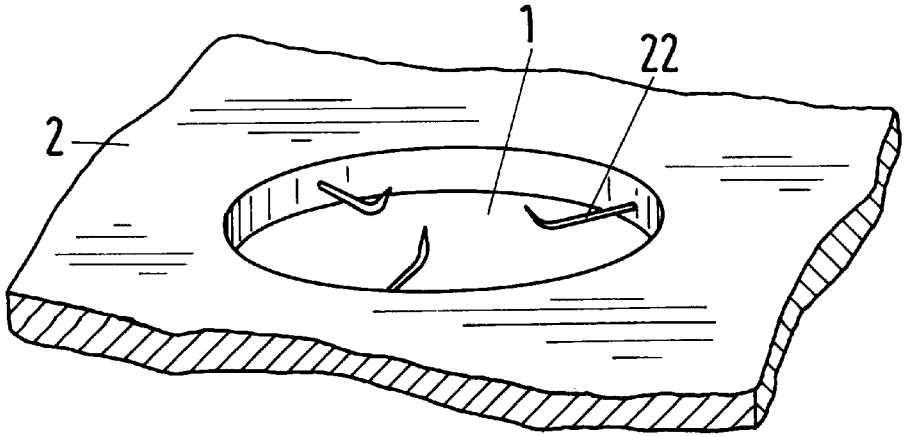
Fig. 2

CLEANING DEVICE FOR PUNCTURE-RESISTANT PROTECTIVE GLOVES AND THE LIKE

BACKGROUND OF THE INVENTION

The invention relates to cleaning equipment for puncture-resistant gloves and the like, puncture-resistant gloves are used in the meat- and fish-processing industry and protect the personnel, working with cutting tools, against hand injuries.

It is understandable that such puncture-resistant gloves become soiled during work, that is, become clogged with meat fibers, meat residues, blood etc. Because of the hygiene regulations in force, it is necessary that these puncture-resistant gloves, which have been soiled during the work, are cleaned thoroughly.

Until now, puncture-resistant gloves were cleaned by taking off the gloves and cleaning them manually with a hose.

This cleaning is difficult and time-consuming and therefore also unfavorable with respect to the working time spent. Furthermore, with the manual cleaning of the puncture-resistant gloves described, it is also very difficult to achieve very thorough cleaning of the puncture-resistant gloves and, with that, to comply with the corresponding hygiene regulations, which are imposed on the food processing industry.

In slaughterhouses, there is a large number of butchers and employees and, accordingly, a large number of puncture-resistant gloves are used. It is understandable that, with the large number of puncture-resistant gloves, which are used and which have to be cleaned, the previously known method of manually cleaning each individual puncture-resistant glove is time consuming and difficult.

SUMMARY OF THE INVENTION

It is an object of the invention to make possible an easier, less expensive and time-saving cleaning of the puncture-resistant gloves and other equipment, as found in the food processing industry.

The invention starts out particularly from the concept of cleaning the soiled puncture-resistant gloves automatically, that is, of making it possible, for example, to suspend several soiled puncture-resistant gloves in an apparatus and, after the cleaning apparatus is started, to clean the soiled puncture-resistant gloves automatically. This automatic cleaning has the advantage that the cleaning takes place according to previously specified criteria and does not depend on the time available or the care of an individual. In addition, this apparatus has the advantage that several puncture-resistant gloves can be cleaned simultaneously, which is advantageous particularly where, because of the large number of meat-processing persons, there is a large number of soiled puncture-resistant gloves, which must be cleaned.

An embodiment of the proposed equipment is shown in the accompanying drawings.

FIG. 1 shows cleaning equipment for puncture-resistant gloves in a perspective view;

FIG. 2 shows a holding device for the puncture-resistant gloves, which are to be cleaned;

DESCRIPTION OF THE PREFERRED EMBODIMENTS

Figure 3:
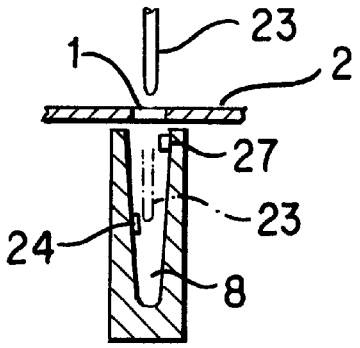
FIG. 3 is a partial cross sectional view of the washing device.
Figure 4:
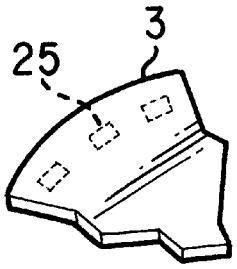
FIG. 4 is a partial plan view of the support plate.
Figure 5:
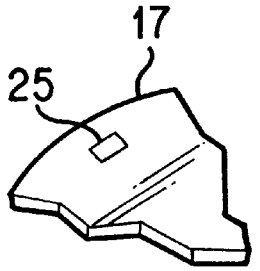
FIG. 5 is a partial plan view of the base which underlies the support plate.
Figure 6:
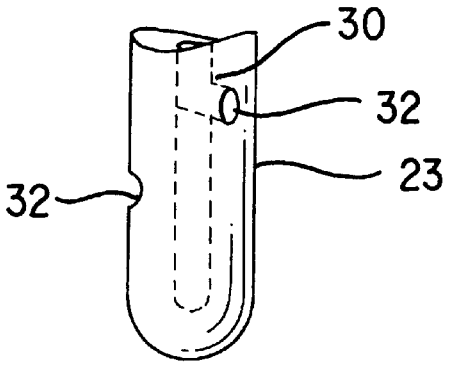
FIG. 6 is a side view of a washing nozzle showing interior structure thereof in dashed lines.

The cleaning equipment in this embodiment is constructed in the form of a carousel, with apertures 1; in which the puncture-resistant gloves 9 are suspended, and disposed in a round holding plate 2. In this embodiment, the holding plate 2 is constructed round. However, it may also have other shapes. On the other hand, it is also possible to transport objects which are to be cleaned, such as puncture-resistant gloves 9, on a different type of conveying equipment, such as an appropriate conveyor belt, conveyor chain, etc.

The holding plate 2 is disposed on a support 17. In a lower region of the support 17, a base plate 3 is disposed which has a diameter smaller than that of the holding plate 2. The holding plate 2, as well as the base plate 3, are driven by a driving mechanism, which is not shown. Moreover, they are driven in the same direction and at the same speed.

Below the holding plate 2, a semi-circular basin 7 is disposed, which is open at top and closed off at sides by side walls, the side walls having an approximately U-shaped opening 8 which is open at the top.

Of course, the basin 7 can also have a different shape or be constructed longer or shorter. On one side of the proposed cleaning equipment, there is a washing unit 19 which is disposed on a support 20; so that the washing unit 19 is extends at a small distance above the rotating holding plate 2. The washing unit includes of a washing nozzle, 23 which is constructed approximately peg-shaped. The outer periphery of this washing nozzle 23 has holes and water under high pressure can be passed into the whole of the washing nozzle, so that this water emerges from the nozzles and cleaning of the puncture-resistant glove is achieved. The washing nozzle in the washing unit 19 is movable and, when there is the aperture below the washing nozzle and the aperture 1 is "filled" with a puncture-resistant glove 9, is lowered into the suspended puncture-resistant glove 9 as indicated in broken lines in FIG. 3. After spray washing with water under high pressure, the washing nozzle 23 is raised once again out of the puncture-resistant glove 9 and, thereupon, lowered into and raised out of the glove a few times once again and, at the same time, sprayed with water or cleaning liquid in order to achieve intensive cleaning of the puncture-resistant glove 9 as a whole by this oscillatory movement. The washing unit 19 also has washing equipment 24 which, is disposed stationarily and sprays water onto the suspended puncture-resistant glove 9 in order to bring about cleaning of the puncture-resistant glove 9 also from the outside. On the other hand, the washing nozzle 23 cleans the puncture-resistant glove 9 from the inside toward the outside in order to achieve an optimum cleaning effect.

Below the base plate 3, metal contacts 25 are disposed in each case to correspond to the apertures 1 in the holding plate 2 above. A sensor 26, which is disposed below the base plate 3, brushes over these contacts. Depending on the information of this sensor, the holding plate 2 is clock controlled by a motorized driving mechanism, that is, whenever there is an aperture 1 below the washing nozzle 23 of the washing unit 19, the driving mechanism of the holding plate 2 stops and the washing nozzle can now be lowered into the aperture 1 and into the glove suspended therein. The arrangement of the sensor and of the individual contact surfaces below the base plate 3 has the advantage that the space below the base plate 3 is protected from spray water and contamination of this technical equipment is therefore prevented.

A second sensor 27 is located in the washing unit 19 and senses whether a puncture-resistant glove 9 is suspended in the aperture 1. If a glove is not suspended, this is recognized by a second sensor and, accordingly, there is no lowering of the washing nozzle 23. Instead, the holding plate 2 is advanced in order to check whether a puncture-resistant glove 9 is suspended in the next aperture 1.

The actual cleaning of the suspended glove 9 takes place under a high pressure of, for example, 200 bar. Either water or a special cleaning solution is suitable for the cleaning. Below the washing unit 19, a discharge pipe 14 is provided, through which the consumed wash water is discharged to a discharging basin 15, which is provided with a screen in order to filter off the coarser components of the effluent. The filtered water is carried away through a discharge pipeline 21.

After the puncture-resistant glove 9 is cleaned, the whole of the holding plate 2 is advanced by means of the motor-driven mechanism. The freshly cleaned glove first of all passes into the region of the basin 7 in which the liquid, dripping from the cleaned glove, is collected.

In order to suspend the gloves 9, the gloves are provided at their cuffs with a textile tape having three openings are. The aperture 1 are provided, in each case, with three upwardly directed hooks 22, as shown FIG. 2. The openings in the cuffs of the puncture-resistant gloves 9 are pushed onto the hooks 22, so that, as can be seen from FIG. 1, the gloves hang down from the holding plate 2 accommodating them.

After the aperture have been loaded with gloves 9 outside of the basin 7, the holding plate 2, by depressing pedal 4, is set in motion, so that it carries out half a revolution, that is, after this movement of the holding plate 2, the aperture 1, loaded with gloves 9, are in the region of the basin 7, and the aperture 1, which are still free, are available to the user and can thus easily be loaded with gloves 9, since the loading is not made difficult by the basin 7 below. After all or most of the aperture 1 have been loaded with gloves 9, the equipment shown is set in motion by pressure on the pedal 5.

The support 17 is constructed like a cupboard and therefore protected against contamination. A door 6 is disposed at the support 17, so that the electronics and the gearing within the support 17 can be attended to. An emergency switch 12 is provided so that the equipment shown can be stopped quickly. The gearing for the movable washing nozzle of the washing unit 19 is located in the housing 11. Two lamps 13 signal if the equipment shown is being operated. When two lamps are lit, water, with a cleaning liquid, is sprayed into the glove 9. After the first washing step, only water is introduced into the glove 9 in order to remove the cleaning liquid and only one lamp 13 is still lit. Of course, the cleaning processes for the puncture-resistant gloves 9 can be adjusted individually as required and depending on the degree of contamination, that is, the nature and number of cleaning processes can be preprogrammed.

With the equipment shown, it is also possible to wash and rinse other devices, which turn up in such slaughter houses, fish-processing plants and the like, such as knives, aprons, etc. By changing the type of suspension for the objects to be cleaned, that is, by not using a hook 22 and using, instead, a flatware holder or the like, it is easily possible to employ this arrangement, for example, for cleaning cutlery.

I claim:

1. A cleaning apparatus for cleaning puncture-resistant gloves with cleaning liquid, comprising:

a support means having holders for holding said gloves;

a washing means provided with a supply means for supplying said cleaning liquid and a washing nozzle for dispensing said cleaning liquid; and said support means being moveable relative to said washing means such that each of said holders on said support means delivers a glove to said washing means where said washing means washes said glove wherein said washing means is movable into and out of said glove.

2. The cleaning apparatus of claim 1 wherein said support means comprises a circular plate.

3. The cleaning apparatus of claim 1 wherein said washing means includes a collecting basin defining a top opening at a top area thereof through which said gloves are suspended in said collecting basin from said holders and said collecting basin underlies said support means for accepting said gloves therein via said top opening.

4. The cleaning apparatus of claim 1 wherein said washing means comprises a washing nozzle having an interior duct for passage of said washing liquid, said interior duct leading to an outer periphery of said washing nozzle.

5. The cleaning apparatus of claim 1 wherein said support means comprises a circular support plate rotatable about an axis of rotation, said washing means including a stationary wash basin having a semi-circular configuration which underlies a semi-circular section of said circular support plate.

6. The cleaning apparatus of claim 5 wherein said circular support plate has an outer peripheral portion, said holders being spaced from one another along said outer peripheral portion.

7. The cleaning apparatus of claim 1 wherein said washing means includes a wash basin having a U-shaped opening through which said gloves pass as said support means rotates.

8. The cleaning apparatus of claim 1 wherein said holders include at least one aperture in said circular plate having hooks for hooking said gloves.

9. The cleaning apparatus of claim 1 further comprising a sensor means, on said washing means, for sensing whether one of said holders is holding a glove.

10. The cleaning apparatus of claim 1 further comprising a driving mechanism for driving said support means relative to said washing means, said driving mechanism including position contacts movable with said support means, and a stationary sensor which brushes over said position contacts.

11. The cleaning apparatus of claim 10 wherein said support means comprises a support plate on which said holders are disposed, said support means further comprising a base plate underlying said support plate, said base plate being spaced from said support plate, said base plate rotating synchronously with said support plate, and said position contacts being disposed on the underside of said base plate.

12. The cleaning apparatus of claim 1 wherein said support means includes a support plate, said holders being disposed on said support plate, said holders suspending said gloves from said support plate, said washing means including a first portion overlying said support plate and a second portion underlying said support plate, said first portion including first nozzle means for directing a washing liquid into the interior of said glove, said second portion including second nozzle means for directing a washing liquid to the exterior of said glove.

13. The cleaning apparatus of claim 12 wherein said second portion of said washing means includes a collection basin for collecting said washing liquid.

14. A cleaning apparatus for cleaning puncture-resistant gloves with cleaning liquid, comprising:

a support means having holders for holding said gloves;

a washing means provided with a supply means for supplying said cleaning liquid and a washing nozzle for dispensing said cleaning liquid; and said support means being moveable relative to said washing means such that each of said holders on said support means delivers a glove to said washing means where said washing means washes said glove wherein said holders include at least one aperture in said circular plate having hooks for hooking said gloves.

15. A cleaning apparatus for cleaning puncture-resistant gloves with cleaning liquid, comprising:

a support means having holders for holding said gloves;

a washing means provided with a supply means for supplying said cleaning liquid and a washing nozzle for dispensing said cleaning liquid;

said support means being moveable relative to said washing means such that each of said holders on said support means delivers a glove to said washing means where said washing means washes said glove; and a sensor means, on said washing means, for sensing whether one of said holders is holding a glove.

16. A cleaning apparatus for cleaning puncture-resistant gloves with cleaning liquid, comprising:

a support means having holders for holding said gloves;

a washing means provided with a supply means for supplying said cleaning liquid and a washing nozzle for dispensing said cleaning liquid; and said support means being moveable relative to said washing means such that each of said holders on said support means delivers a glove to said washing means where said washing means washes said glove; and a driving mechanism for driving said support means relative to said washing means, said driving mechanism including position contacts movable with said support means, and a stationary sensor which brushes over said position contacts.

17. The cleaning apparatus of claim 16 wherein said support means comprises a support plate on which said holders are disposed, said support means further comprising a base plate underlying said support plate, said base plate being spaced from said support plate, said base plate rotating synchronously with said support plate, and said position contacts being disposed on the underside of said base plate.

18. A cleaning apparatus for cleaning puncture-resistant gloves with cleaning liquid, comprising:

a support means having holders for holding said gloves;

a washing means provided with a supply means for supplying said cleaning liquid and a washing nozzle for dispensing said cleaning liquid; and said support means being moveable relative to said washing means such that each of said holders on said support means delivers a glove to said washing means where said washing means washes said glove; and said support means including a support plate, said holders being disposed on said support plate, said holders suspending said gloves from said support plate, said washing means including a first portion overlying said support plate and a second portion underlying said support plate, said first portion including first nozzle means for directing a washing liquid into the interior of said glove, said second portion including second nozzle means for directing a washing liquid to the exterior of said glove.

19. The cleaning apparatus of claim 18 wherein said second portion of said washing means includes a collection basin for collecting said washing liquid.

* * * * *